US010514029B2

(12) United States Patent
Suarez

(10) Patent No.: US 10,514,029 B2
(45) Date of Patent: Dec. 24, 2019

(54) AIR INLET CONTROL FOR AIR COMPRESSOR

(71) Applicant: AC (Macao Commercial Offshore) Limited, Macau (MO)

(72) Inventor: Joseph Suarez, Anderson, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 615 days.

(21) Appl. No.: 15/044,944

(22) Filed: Feb. 16, 2016

(65) Prior Publication Data

US 2016/0238000 A1 Aug. 18, 2016

Related U.S. Application Data

(60) Provisional application No. 62/205,439, filed on Aug. 14, 2015, provisional application No. 62/116,793, filed on Feb. 16, 2015.

(51) Int. Cl.
*F04B 49/22* (2006.01)
*F04B 35/04* (2006.01)
(Continued)

(52) U.S. Cl.
CPC ..... *F04B 49/22* (2013.01); *F04B 35/04* (2013.01); *F04B 35/06* (2013.01); *F04B 39/08* (2013.01);
(Continued)

(58) Field of Classification Search
CPC ..... F04B 49/22; F04B 49/06; F04B 39/0094; F04B 39/123; F04B 39/125; F04B 53/14;
(Continued)

(56) References Cited

U.S. PATENT DOCUMENTS 3,594,093 A * 7/1971 Lukacs ..... F04D 27/0284 417/282
3,778,695 A * 12/1973 Bauer, Jr. ..... F04D 27/0276 318/481
(Continued)

FOREIGN PATENT DOCUMENTS

JP 07293477 A * 11/1995
JP 2000045957 A 2/2000
(Continued)

OTHER PUBLICATIONS

European Search Report for Application No. 16155955 dated Jun. 13, 2016 (1 page).

*Primary Examiner* — Nathan C Zollinger
(74) *Attorney, Agent, or Firm* — Michael Best & Friedrich LLP

(57) ABSTRACT

An air compressor system operably coupled to a power supply including an air storage tank and an air pump including an air manifold having an inlet configured to receive ambient air. The air pump is fluidly coupled to the air storage tank. The air compressor system also includes a motor having a first current level provided by the power supply to operate the air pump, a valve member in fluid communication with the inlet of the air manifold, and a controller operable to move the valve member to either increase or decrease a rate of ambient air traveling into the manifold. The controller monitors the first current level of the motor to change the rate of ambient air traveling into the manifold.

19 Claims, 12 Drawing Sheets

(51) Int. Cl.

| | |
|---|---|
| ***F04B 35/06*** | (2006.01) |
| ***F04B 41/02*** | (2006.01) |
| ***F04B 49/06*** | (2006.01) |
| ***F04B 39/12*** | (2006.01) |
| ***F04B 39/08*** | (2006.01) |
| ***F04B 39/10*** | (2006.01) |

(52) U.S. Cl.
CPC ..... *F04B 39/10* (2013.01); *F04B 39/123* (2013.01); *F04B 41/02* (2013.01); *F04B 49/06* (2013.01); *F04B 2203/0201* (2013.01); *F04B 2203/0202* (2013.01)

(58) Field of Classification Search
CPC ..... F04B 51/00; F04B 35/04; F04B 35/06; F04B 41/02; F04B 2203/0201; F04B 2203/0202; F04B 39/08; F04B 39/10; F04B 49/03
See application file for complete search history.

(56) References Cited

U.S. PATENT DOCUMENTS 4,060,340 A 11/1977 Yanik et al.
4,558,994 A 12/1985 Viola et al.
4,664,601 A 5/1987 Uchida
4,968,221 A 11/1990 Noll
4,975,024 A * 12/1990 Heckel ..... F04D 27/0284 417/18
5,046,928 A * 9/1991 Peterson ..... F04D 27/0207 417/282
5,388,967 A 2/1995 Firnhaber et al.
5,411,375 A 5/1995 Bauer
5,456,582 A 10/1995 Firnhaber et al.
5,540,558 A * 7/1996 Harden ..... F04B 49/03 251/129.19
5,556,271 A 9/1996 Zuercher et al.
5,694,682 A 12/1997 Zuercher et al.
RE36,274 E 8/1999 Zuercher et al.
RE36,281 E 8/1999 Zuercher et al.
6,027,315 A 2/2000 Hogan
6,056,516 A 5/2000 Schoenfeld
6,120,260 A 9/2000 Jirele
6,254,358 B1 7/2001 Merz
6,336,797 B1 1/2002 Kazakis et al.
6,676,388 B2 1/2004 Lee et al.
6,811,384 B2 11/2004 Virgilio
7,086,841 B2 8/2006 Cornwell
7,153,106 B2 12/2006 Cornwell
7,648,343 B2 1/2010 Cornwell
7,704,052 B2 * 4/2010 Iimura ..... F04B 41/02 417/44.1
7,811,067 B2 10/2010 Dietzsch et al.
8,740,013 B2 6/2014 Elberson
8,920,133 B2 12/2014 Bosua
2004/0141862 A1 7/2004 Cornwell
2004/0213679 A1 * 10/2004 Cornwell ..... F04B 39/10 417/307
2007/0065302 A1 3/2007 Schmitz
2007/0154335 A1 7/2007 Cornwell
2010/0290929 A1 11/2010 Ohi
2010/0329898 A1 12/2010 Dunn et al.
2011/0194901 A1 8/2011 Carlson
2011/0277625 A1 11/2011 Deikmeyer et al.
2011/0311382 A1 * 12/2011 Berwanger ..... F04B 7/0076 417/415
2013/0139535 A1 * 6/2013 Nares ..... F04B 49/00 62/228.1

FOREIGN PATENT DOCUMENTS

JP 2001082380 A * 3/2001
JP 2008116565 A * 5/2008 ..... G09G 3/001
WO WO-2014047377 A2 3/2014

* cited by examiner

AIR INLET CONTROL FOR AIR COMPRESSOR

CROSS-REFERENCES TO RELATED APPLICATIONS

This applications claims benefit of and priority to U.S. Provisional Patent Application No. 62/116,793, filed Feb. 16, 2015, and U.S. Provisional Patent Application No. 62/205,439, filed Aug. 14, 2015, the entire contents of which are hereby incorporated by reference herein.

BACKGROUND

The present invention relates to air compressor systems, and more particularly to air inlet control valves for air compressor systems.

SUMMARY

In one aspect, the invention provides an air compressor system operably coupled to a power supply including an air storage tank and an air pump including an air manifold having an inlet configured to receive ambient air. The air pump is fluidly coupled to the air storage tank. The air compressor system also includes a motor having a first current level provided by the power supply to operate the air pump, a valve member in fluid communication with the inlet of the air manifold, and a controller operable to move the valve member to either increase or decrease a rate of ambient air traveling into the manifold. The controller monitors the first current level of the motor to change the rate of ambient air traveling into the manifold.

In another aspect, the invention provides an air compressor system operably coupled to a power supply including an air storage tank and an air pump including an air manifold having an inlet configured to receive ambient air. The air pump is fluidly coupled to the air storage tank. The air compressor system also includes a motor having a first angular velocity corresponding to a current level of the power supply to operate the air pump, a valve member in fluid communication with the inlet of the air manifold, and a controller operable to move the valve member to either increase or decrease a rate of ambient air traveling into the manifold. The controller monitors the first angular velocity of the motor to change the rate of ambient air traveling into the manifold.

In yet another aspect, the invention provides an air compressor system operably coupled to a power supply including an air storage tank and an air pump including an air manifold having an inlet configured to receive ambient air. The air pump is fluidly coupled to the air storage tank. The air compressor system also includes a motor operable at a first parameter corresponding to a current level of the power supply to operate the air pump, a valve member in fluid communication with the inlet of the air manifold, and a controller including a determined parameter of the motor to operate the air pump. The controller is coupled to the valve member, and the controller is configured to monitor the first parameter of the motor, compare the first parameter and the determined parameter of the motor, and move the valve member to change a rate of ambient air traveling into the air manifold.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
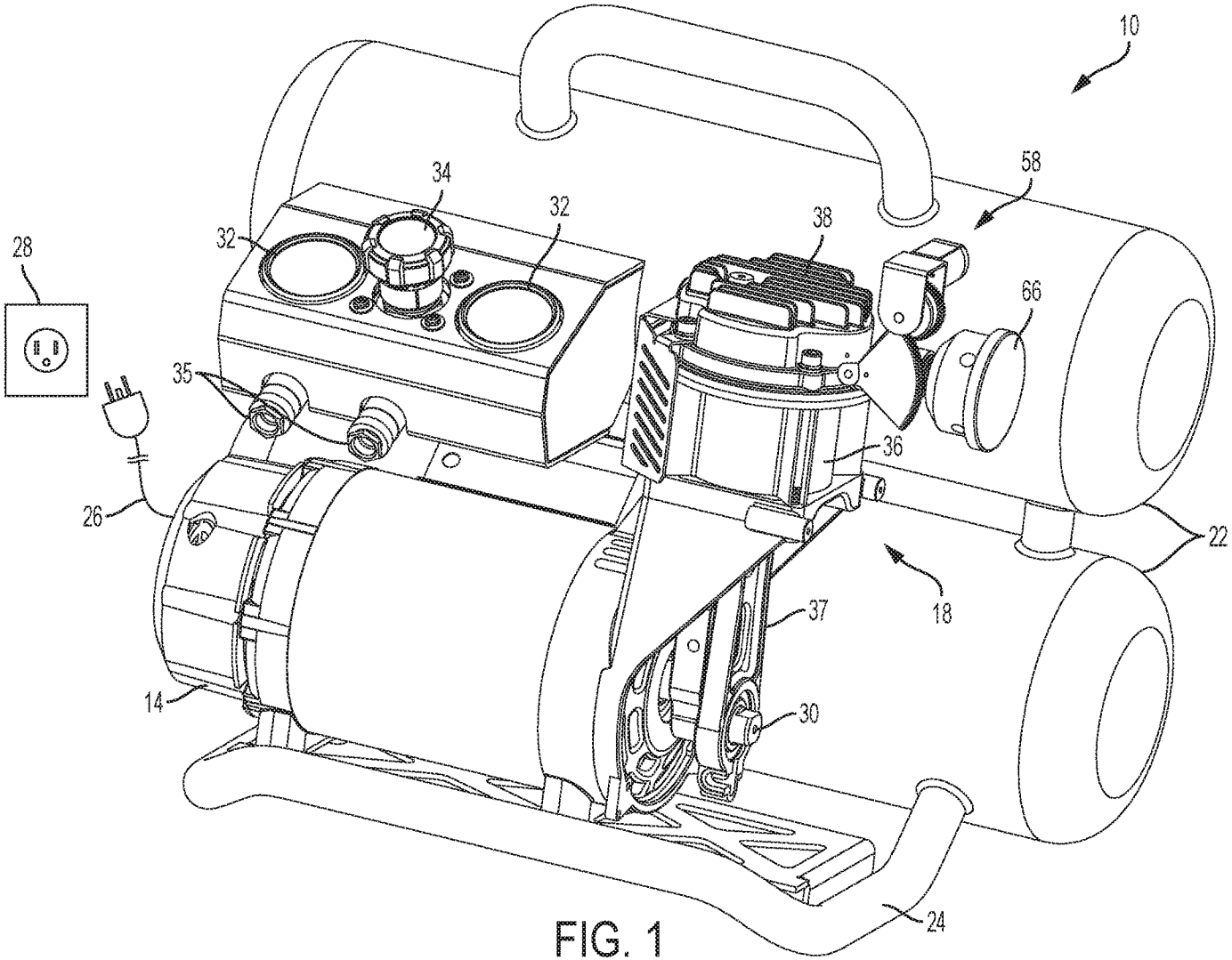
FIG. 1 is a perspective view of an air compressor system including an air inlet control valve according to an embodiment of the invention.

FIG. 1 illustrates an air compressor system 10 including a motor 14, an air pump 18, and air storage tanks 22 fixedly coupled together by a frame 24. The motor 14 includes an electrical cord 26 that is selectively coupled to a power supply 28, e.g., AC power supply (120 volts, 230 volts, etc.). In other embodiments, the motor 14 is operable by a DC power supply (e.g., a battery). The motor 14 is driveably coupled to the air pump 18 via a crank shaft 30 to pump ambient air into the air storage tanks 22. Air gauges 32 and a regulator knob 34 are fluidly coupled to the air storage tanks 22 to monitor and control air entering and exiting the air storage tanks 22. In particular, fittings 35 are configured to provide fluid communication between at least one pneumatic tool (e.g., nailer, drill, etc.) and the air storage tanks 22 to operate the pneumatic tool.

Figure 2:
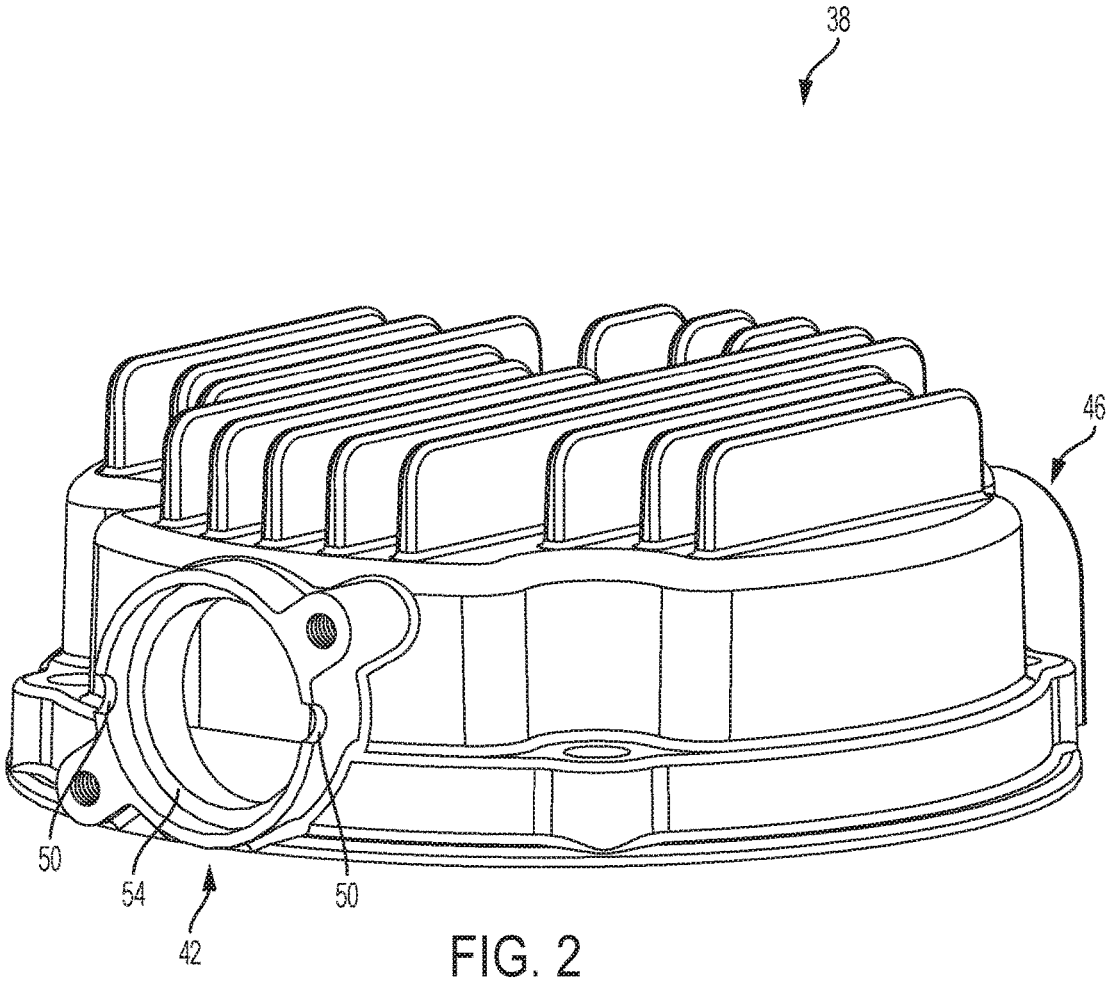
FIG. 2 is a perspective view of an air intake manifold of the air compressor system of FIG. 1.

The illustrated air pump 18 includes a piston head (not shown) located within a cylinder head 36 with the piston head coupled to the crank shaft 30 by a piston rod 37. With reference to FIG. 2, an air intake manifold 38 is coupled to a top portion of the cylinder head 36 and includes an inlet 42 and an outlet 46. The illustrated inlet 42 includes opposing semi-circular grooves 50 located on an outer circumference of the inlet 42 and a stepped surface 54 defining a minimum inner diameter of the inlet 42. The inlet 42 is located fluidly between the ambient air and a compression chamber, which is defined by the cylinder head 36, the piston head, and the manifold 38, whereas the outlet 46 is located fluidly between the compression chamber and the air storage tanks 22. Check valves (not shown) are associated with the inlet 42 and the outlet 46 allowing air to flow in only one direction (e.g., into the air storage tanks 22).

Figure 3:
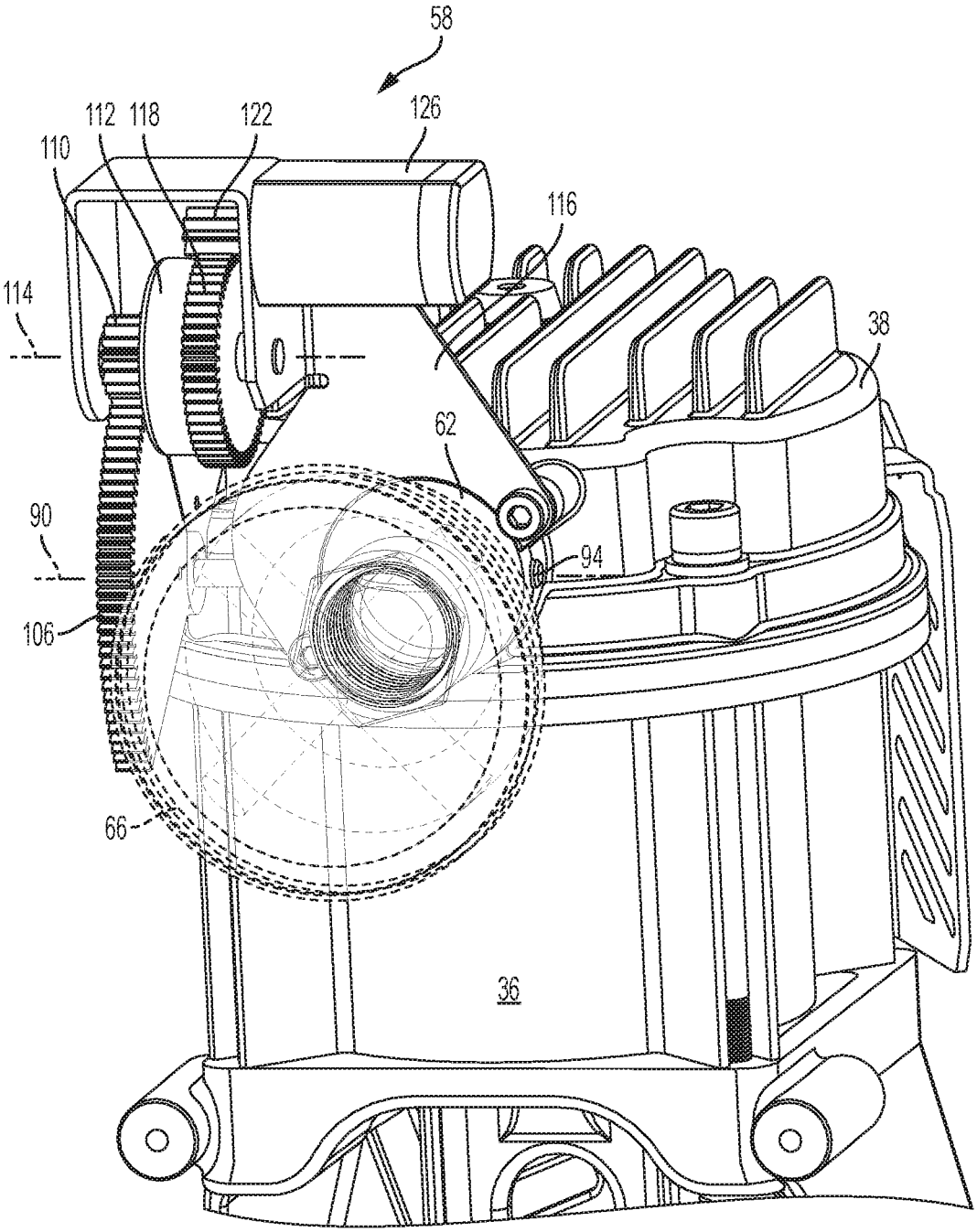
FIG. 3 is a perspective view of the air inlet control valve of FIG. 1.

With reference to FIG. 3, an air inlet control valve 58 is coupled to the air intake manifold 38 and is configured to regulate the ambient air entering the inlet 42. An inlet conduit 62 is attached to a filter housing 66 (illustrated in phantom in FIG. 3), which includes an air filter (not shown), by threadably engaging a portion of the filter housing 66 to the inlet conduit 62. The illustrated inlet conduit 62 is directly attached to the air intake manifold 38 by fasteners and includes semi-circular grooves 70 (FIG. 4) that correspond to the semi-circular grooves 50 of the inlet 42.

Figure 4:
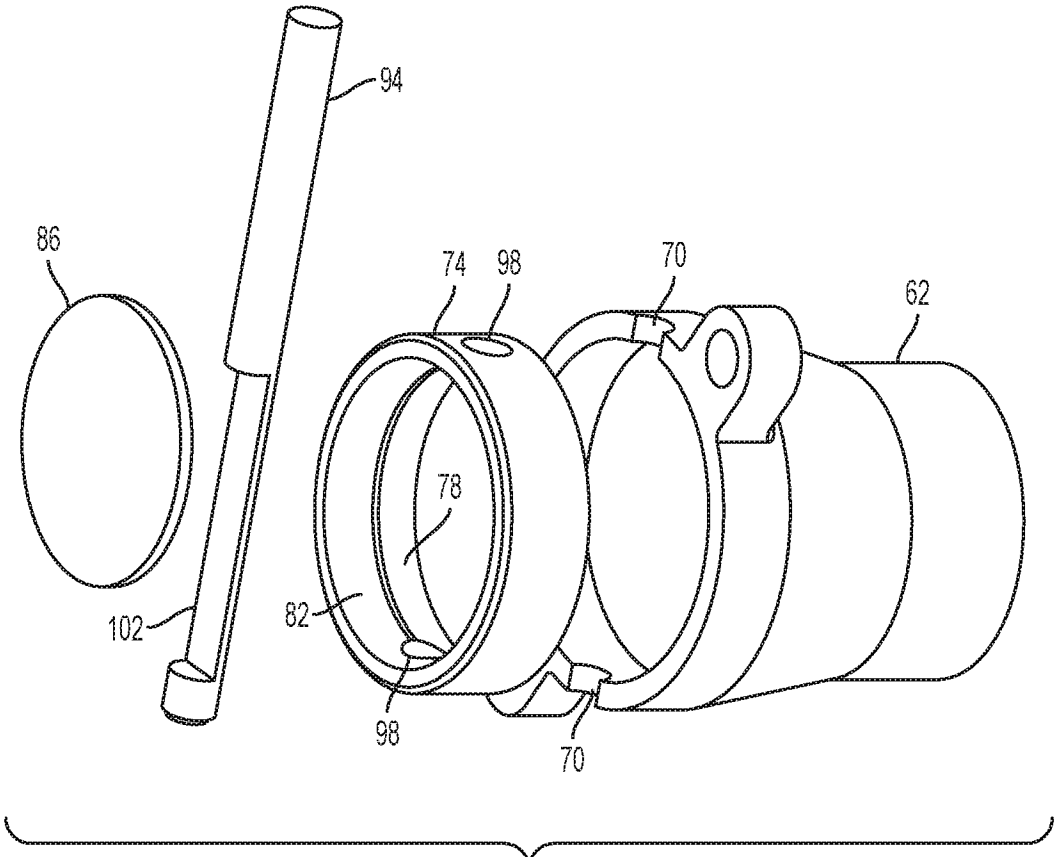
FIG. 4 is an exploded view of a portion of the air inlet control valve of FIG. 3 including a sealing member coupled to an intake conduit.
Figure 5:
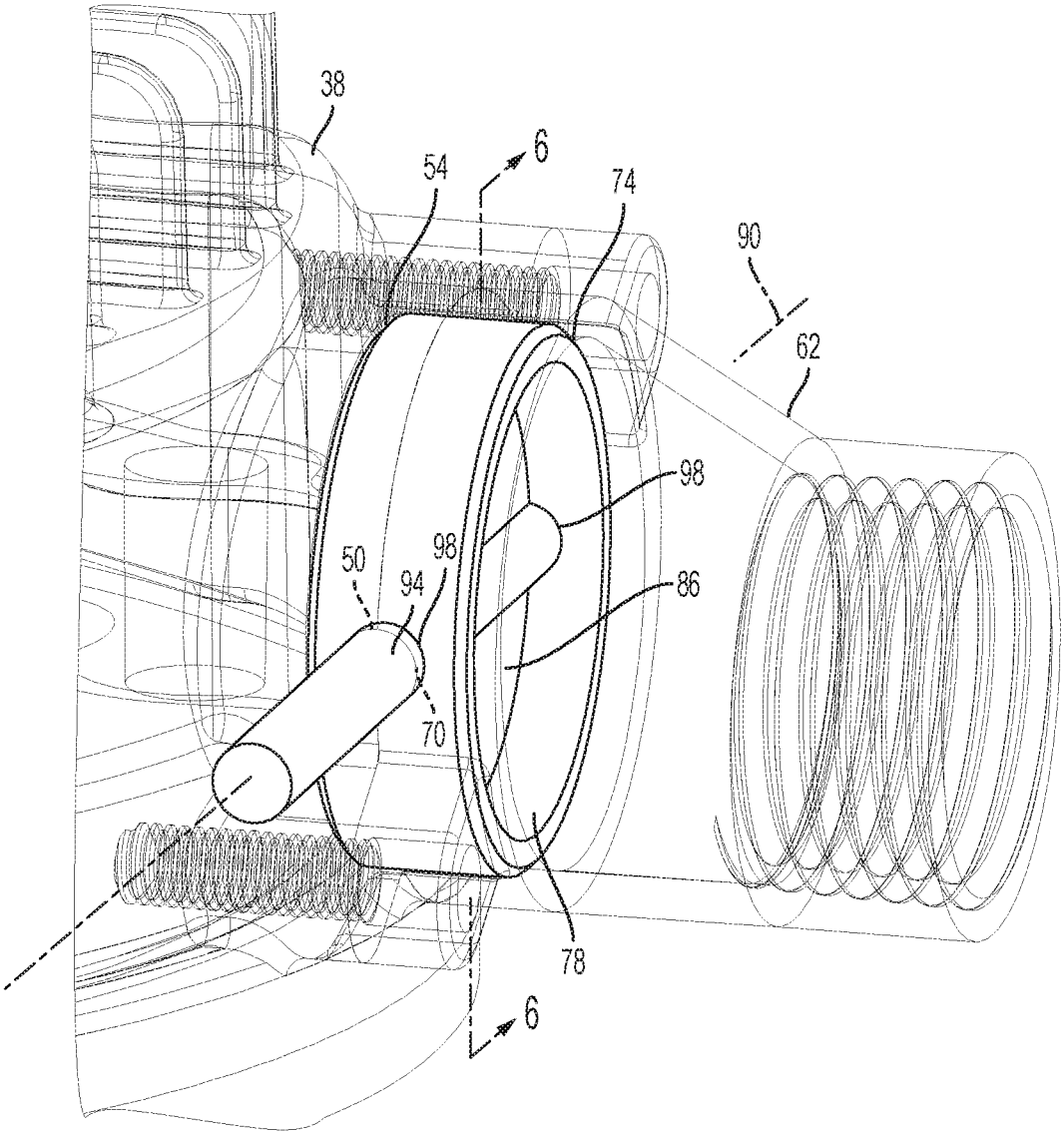
FIG. 5 is a perspective view of the sealing member of FIG. 4 positioned between the air intake manifold and the intake conduit.
Figure 6:
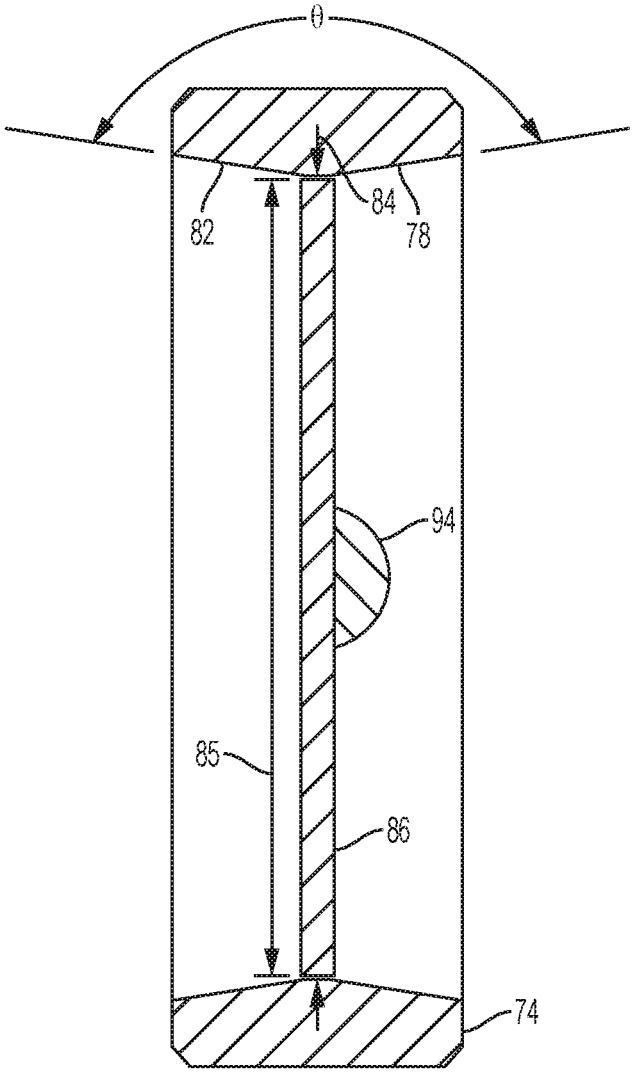
FIG. 6 is a cross-sectional view taken along 6-6 of FIG. 5.

With reference to FIGS. 4-6, a sealing member 74 includes an interior inlet surface 78 associated with (e.g., facing towards) the inlet conduit 62 and an interior outlet surface 82 associated with (e.g., facing towards) the air intake manifold 38 with an angle θ defined between the surfaces 78, 82. In the illustrated embodiment, the angle θ is an oblique angle. The illustrated angle θ promotes a Venturi effect of airflow passing through the sealing member 74 such that airflow is accelerated from the interior inlet surface 78 to the interior outlet surface 82.

An inner diameter 84 of the sealing member 74 defined between the surfaces 78, 82 is sized to receive an outer diameter 85 of a valve member 86. In the illustrated embodiment, the valve member 86 rotates about a first axis 90 by a shaft 94, which is also known as a butterfly valve. The shaft 94 is received through the sealing member 74 by apertures 98 (FIG. 4), and the shaft 94 is sized to be located between the semi-circular grooves 50, 70. The illustrated valve member 86 is a disk received within a recess 102 of the shaft 94 and attached thereto by a fastener. In other embodiments, the recess 102 may be a slot or elongated aperture with the valve member 86 received therethrough. In other embodiments, a biasing member (e.g., torsional spring) may be concentric with the shaft 94 and operable to bias the shaft 94 in a rotational direction.

Referring back to FIG. 3, the air inlet control valve 58 includes a gearing system having a first drive gear 106 attached to the shaft 94 for co-rotation therewith. In the illustrated embodiment, a keyway and a key are included between the shaft 94 and the first drive gear 106 to inhibit relative rotation therebetween. The first drive gear 106 includes teeth that mesh with teeth of a first intermediate gear 110 that rotates about a second axis 114, which is offset from the first axis 90. The first intermediate gear 110 is supported about the second axis 114 by a bracket 116, which is attached to the inlet conduit 62 by the same fasteners that attach the inlet conduit 62 to the air intake manifold 38. A clutch mechanism 112 is coupled between the first intermediate gear 110 and a second intermediate gear 118 and allows for relative rotational slip between the first drive gear 106 and the second intermediate gear 118. The second intermediate gear 118 is also rotatably supported about the second axis 114 by the bracket 116. In the illustrated embodiment, a second drive gear 122 that is driven by a controller 126 includes teeth that mesh with teeth of the second intermediate gear 118.

Figure 7:
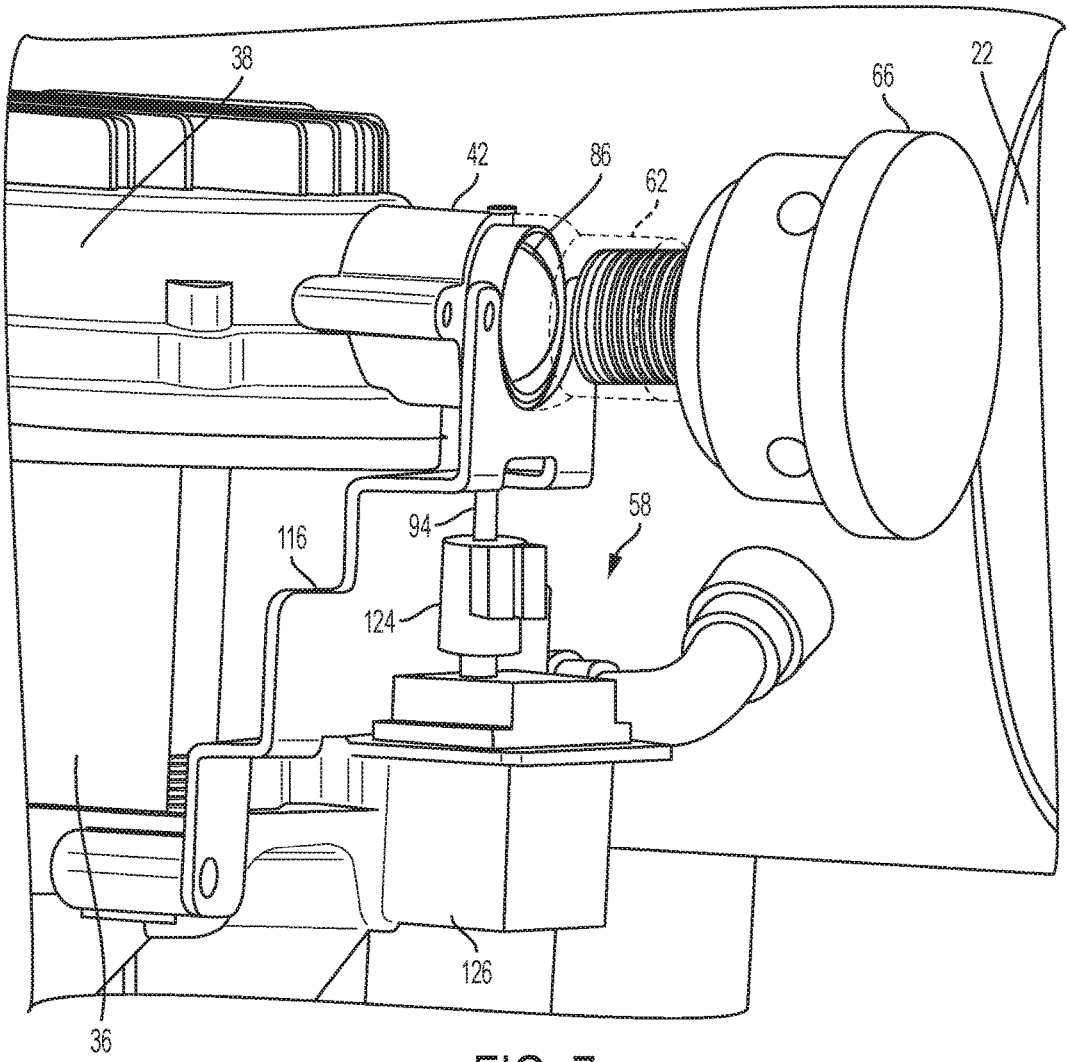
FIG. 7 is a perspective view of an air inlet control valve according to an embodiment of the invention.

In another embodiment of the air inlet control valve 58 as illustrated in FIG. 7, the gearing system (e.g., the gears 106, 110, 118, 122 and the clutch 112) is omitted, thereby connecting the valve member 86 to the controller 126 by the shaft 94. In this embodiment, the shaft 94 may be directly connected to the controller 126 by a fitting 124.

The illustrated controller 126 is in electrical communication with other components of the air compressor system 10 to monitor a performance parameter of the component. For example, the controller 126 may monitor a rotational velocity of the motor 14 that drives the air pump 18, and/or the controller 126 may monitor an amount of electrical current traveling through the motor 14 that is provided by the power supply 28 to operate the air pump 18. In other embodiments, the controller 126 may monitor other performance parameters of the air compressor system 10.

Figure 8:
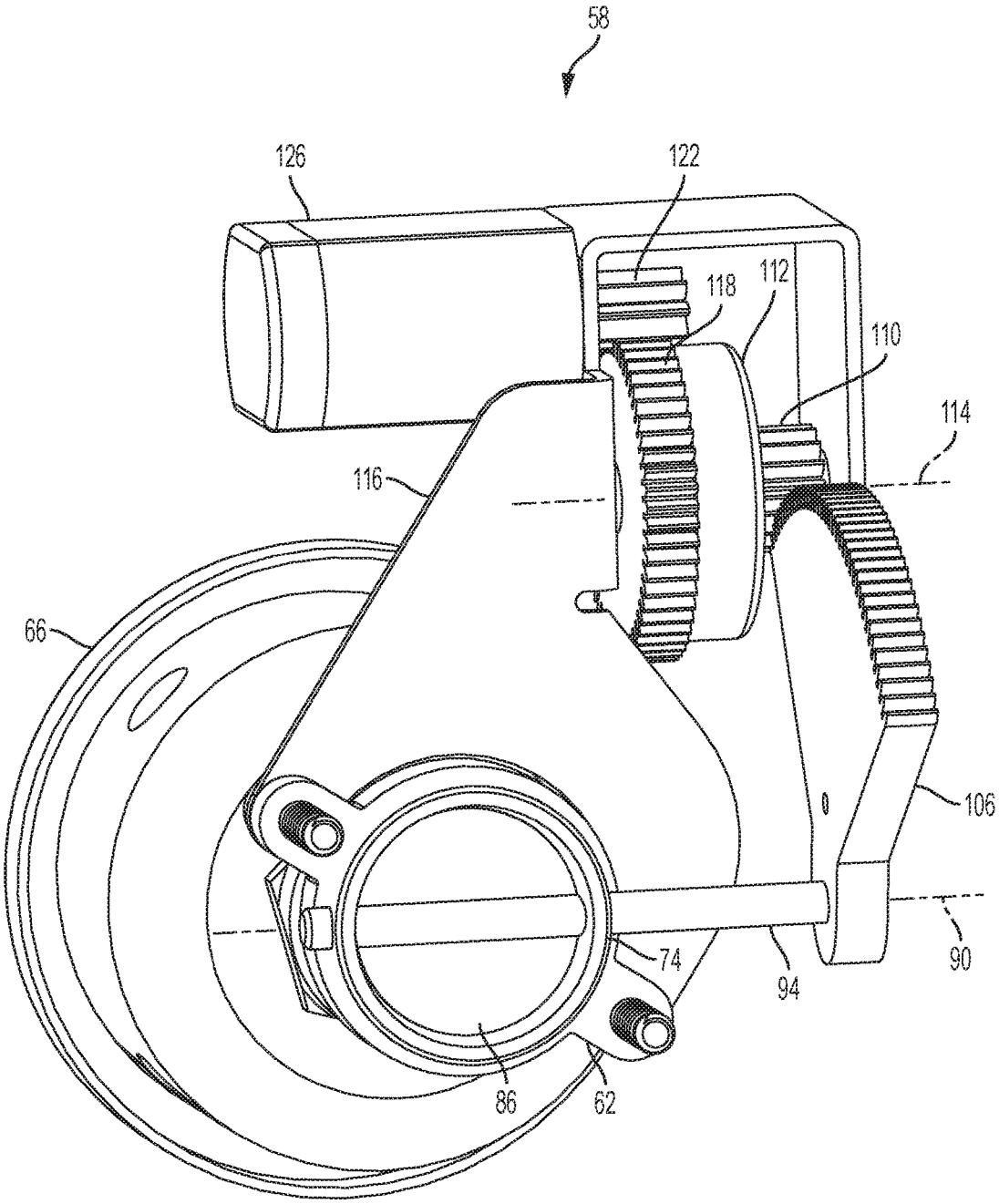
FIG. 8 is a perspective view of the air inlet control valve of FIG. 3 in a closed position.

In operation, the air inlet control valve 58 can be adjusted in a plurality of positions to regulate an airflow rate of ambient air from the filter housing 66 into the air intake manifold 38. FIG. 8 illustrates the air inlet control valve 58 in a closed position, wherein the valve member 86 is automatically returned to (e.g., via the controller 126) a position to substantially abut the sealing member 74 to limit the airflow rate into the air intake manifold 38. The closed position of the air inlet control valve 58 is observed upon initial startup of the motor 14. In particular, the load on the motor 14 is relatively high during initial startup of the air compressor system 10 resulting in a relatively high amount of electrical current (i.e., a current spike) required by the motor 14 to drive the air pump 18. By closing the air inlet control valve 58, the majority of the electrical current supplied to the motor 14 by the power supply 28 is utilized to begin rotational movement of the air pump 18 without the added load on the motor 14 caused by compressing ambient air within the air pump 18. After initial startup of the motor 14, the motor 14 increases in angular velocity as the current spike to operate the air pump 18 decreases.

Figure 9:
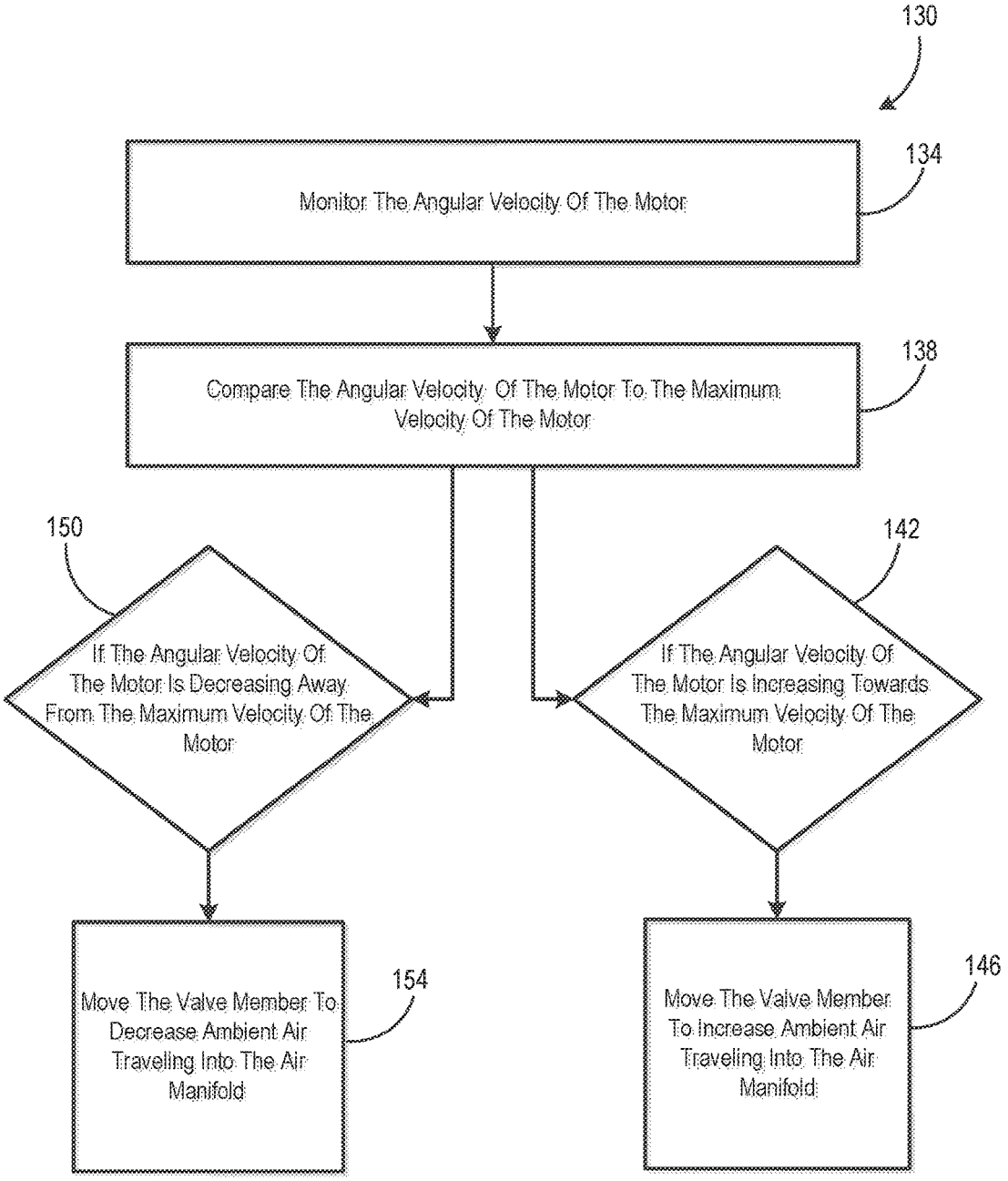
FIG. 9 illustrates a method of operation of the air compressor system according to an embodiment of the invention.
Figure 10:
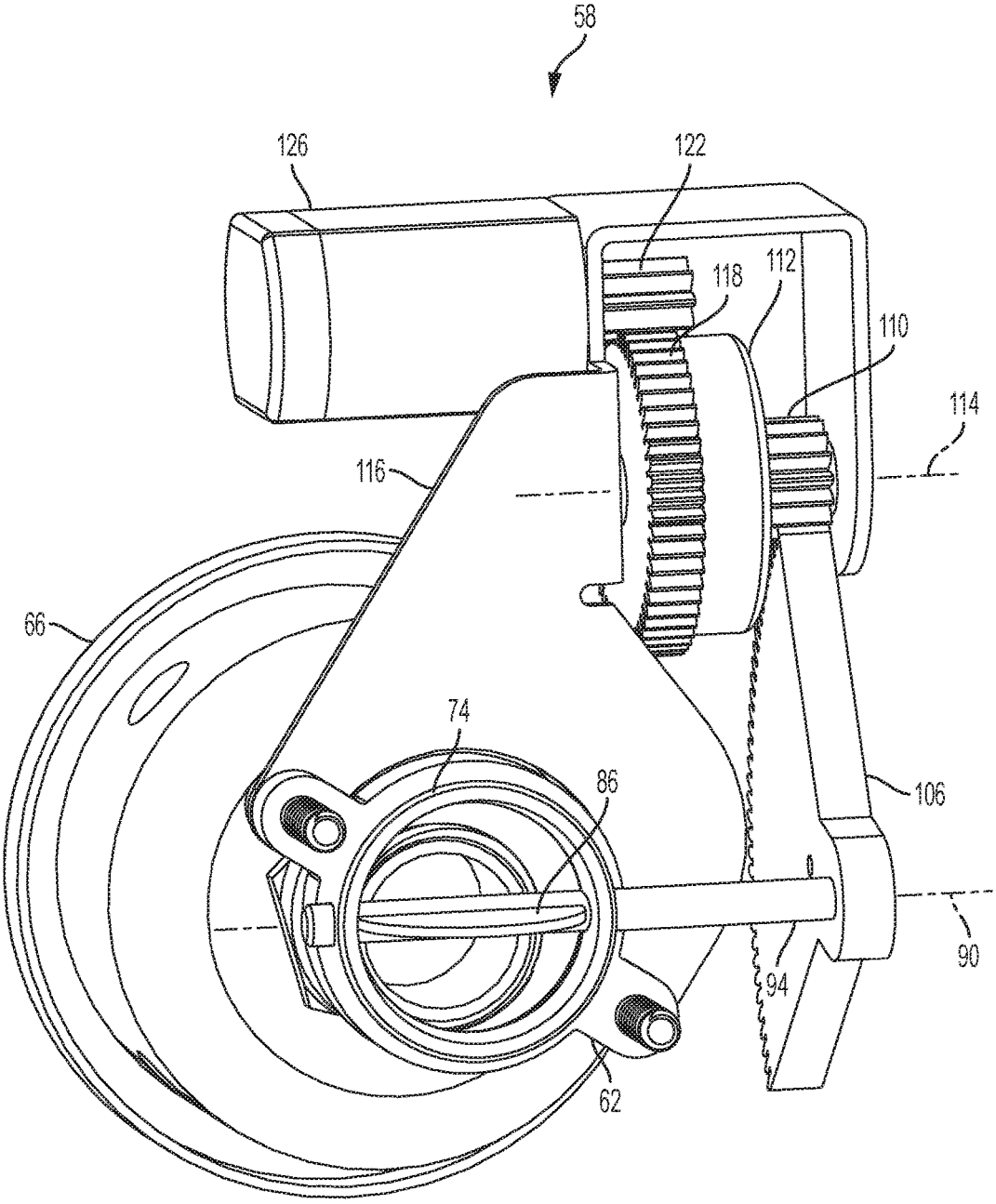
FIG. 10 is a perspective view of the air inlet control valve of FIG. 3 in an open position.

With reference to FIG. 9, a method of operation 130 of the air compressor system 10 is illustrated with the controller 126 monitoring an angular velocity of the motor 14 (step 134). The illustrated controller 126 then compares the actual angular velocity to a maximum angular velocity of the motor 14 (step 138). In some embodiments, the maximum angular velocity of the motor 14 corresponds to a maximum current level of the power supply 28 and a maximum performance of the air compressor system 10. If the angular velocity of the motor 14 is increasing towards the maximum velocity of the motor 14 (step 142), then the air inlet control valve 58 begins to move into an open position (step 146), as illustrated in FIG. 10. As such, the airflow rate from the filter housing 66 into the air intake manifold 38 increases, thereby increasing the performance of the air compressor system 10, e.g., increasing an amount of ambient air pumped into the air storage tanks 22.

In the embodiment of the air inlet control valve 58 including the gearing system, the second drive gear 122 rotates in a direction to rotate the first drive gear 106, through the intermediate gears 110, 118 and the clutch 112, to rotate the valve member 86. In the illustrated embodiment, the controller 126 moves the valve member 86 at a velocity inversely proportional (i.e., a quadratic relationship) to a rate of the angular velocity change of the motor 14. In other embodiments, the controller 126 may move the valve member 86 at a velocity that is linear to a rate of the angular velocity change of the motor 14. In further embodiments, the valve member 86 remains in the closed position (FIG. 8) until the angular velocity of the motor 14 is substantially equal to the maximum velocity of the motor 14, and then the controller 126 moves the valve member 86 towards the open position (FIG. 10).

However, if the angular velocity of the motor 14 is decreasing away from the maximum angular velocity of the motor 14 (step 150), the controller 126 begins to rotate the valve member 86 back towards the closed position (step 154). In some embodiments, the angular velocity of the motor 14 decreases because a current level of the power supply 28 supplied to the motor 14 decreases. However, as the valve member 86 moves back towards the closed position, the load on the motor 14 produced by the air pump 18 decreases. With the load on the motor 14 decreased, less electrical current is needed to operate the motor 14 at the maximum angular velocity. In other words, the illustrated air inlet control valve 58 regulates the rate of ambient air traveling into the air intake manifold 38 to control the load on the motor 14, and ultimately the amount of electrical current needed to power the air pump 18, to match the available electrical current provided by the power supply 28.

When the motor 14 is turned off after operation, the air inlet control valve 58 automatically moves back into the closed position (FIG. 8). Specifically, the controller 126 defaults the valve member 86 in the closed position anticipating the next startup of the motor 14. In the other embodiments wherein the torsional spring is associated with the shaft 94, the torsional spring biases the first drive gear 106, the shaft 94, and the valve member 86 into the closed position. The illustrated clutch 112 inhibits the first drive gear 106 to back-drive the second drive gear 122 when the motor 14 is turned off and the first drive gear 106 returns to the closed position under the biasing force of the torsional spring.

Figure 11:
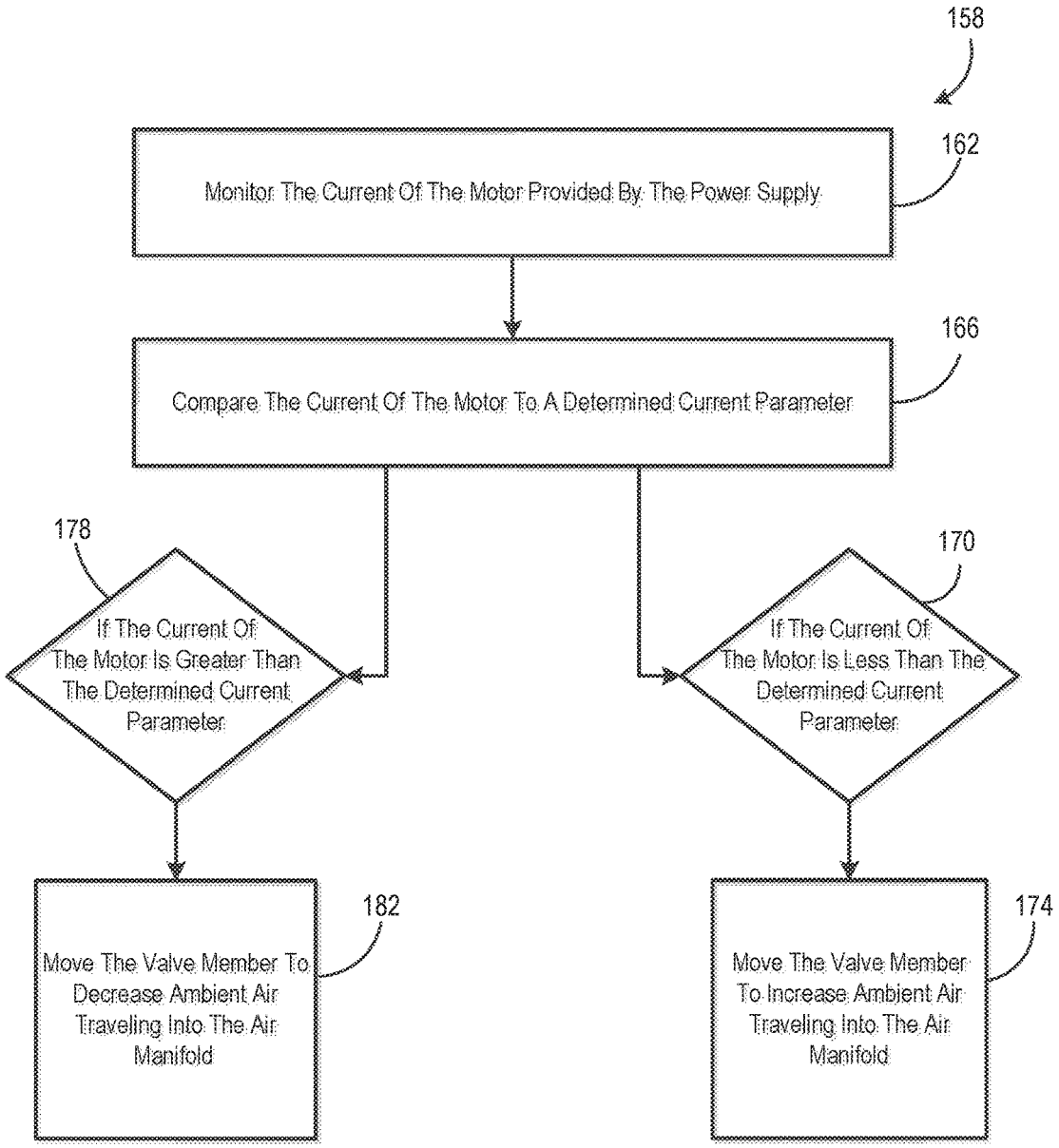
FIG. 11 illustrates a method of operation of the air compressor system according to another embodiment of the invention.

Similarly to how the controller 126 monitors the angular velocity of the motor 14 to regulate the air inlet control valve 58, in another embodiment, the controller 126 monitors an amount of electrical current traveling through the motor 14 to regulate the air inlet control valve 58. After initial startup of the motor 14, the current level of the motor 14 to operate the air pump 18 decreases as the current spike decreases. With reference to FIG. 11, a method of operation 158 of the air compressor system 10 is illustrated with the controller 126 monitoring an amount of electrical current traveling through the motor 14 (step 162). The illustrated controller 126 then compares the current level to a threshold current level of the motor 14 (step 166). In some embodiments, the threshold current level of the motor 14 corresponds to an optimum current or power level of the motor 14, and/or the threshold current level of the motor 14 may correspond to the maximum current output of the power supply 28. If the amount of current traveling through the motor 14 is below the threshold current level (step 170), the controller 126 moves the valve member 86 to increase the airflow rate into the air intake manifold 38 (step 174) to increase the performance of the air compressor system 10. However, if the amount of current traveling through the motor 14 is above the threshold current level (step 178), e.g., the current level needed to operate the air pump 18 is greater than the available current level from the power supply 28, the controller 126 moves the valve member 86 to decrease the airflow rate into the air intake manifold 38 (step 182). In the illustrated embodiment, the controller 126 moves the valve member 86 at a velocity inversely proportional (i.e., a quadratic relationship) to a rate of the electrical current change of the motor 14. In other embodiments, the controller 126 may move the valve member 86 at a velocity that is linear to a rate of the electrical current change of the motor 14.

Accordingly, the air inlet control valve 58 regulates the airflow rate by rotating the valve member 86 towards the open position or the closed position to maximize the performance of the air compressor system 10 dependent upon the available electrical current from the power supply 28. In other words, the controller 126 is continuously monitoring (e.g., a closed loop feedback system) the angular velocity of the motor 14, the current level traveling through the motor 14, or both to regulate the air flow traveling into the air intake manifold 38 by the valve member 86.

In other embodiments, the valve member 86 may be moveable in two positions, e.g., a partially closed position and an open position (FIG. 10). As such, the valve member 86 begins in the partially closed position upon startup and then moves to the open position after startup. The controller 126 moves the valve member 86 from the partially closed position to the open position once a threshold of the motor 14 (e.g., a maximum angular velocity threshold, an electrical current threshold, etc.) is reached. In further embodiments, the controller 126 moves the valve member 86 from the partially closed position to the open position after a determined amount of time passes after startup of the motor 14. In one embodiment, the valve member 86 stays in the open position until the air compressor system 10 is turned off. The valve member 86 defaults back into the partially closed position by the controller 126 or the torsional spring, as described in further detail above.

Figure 12:
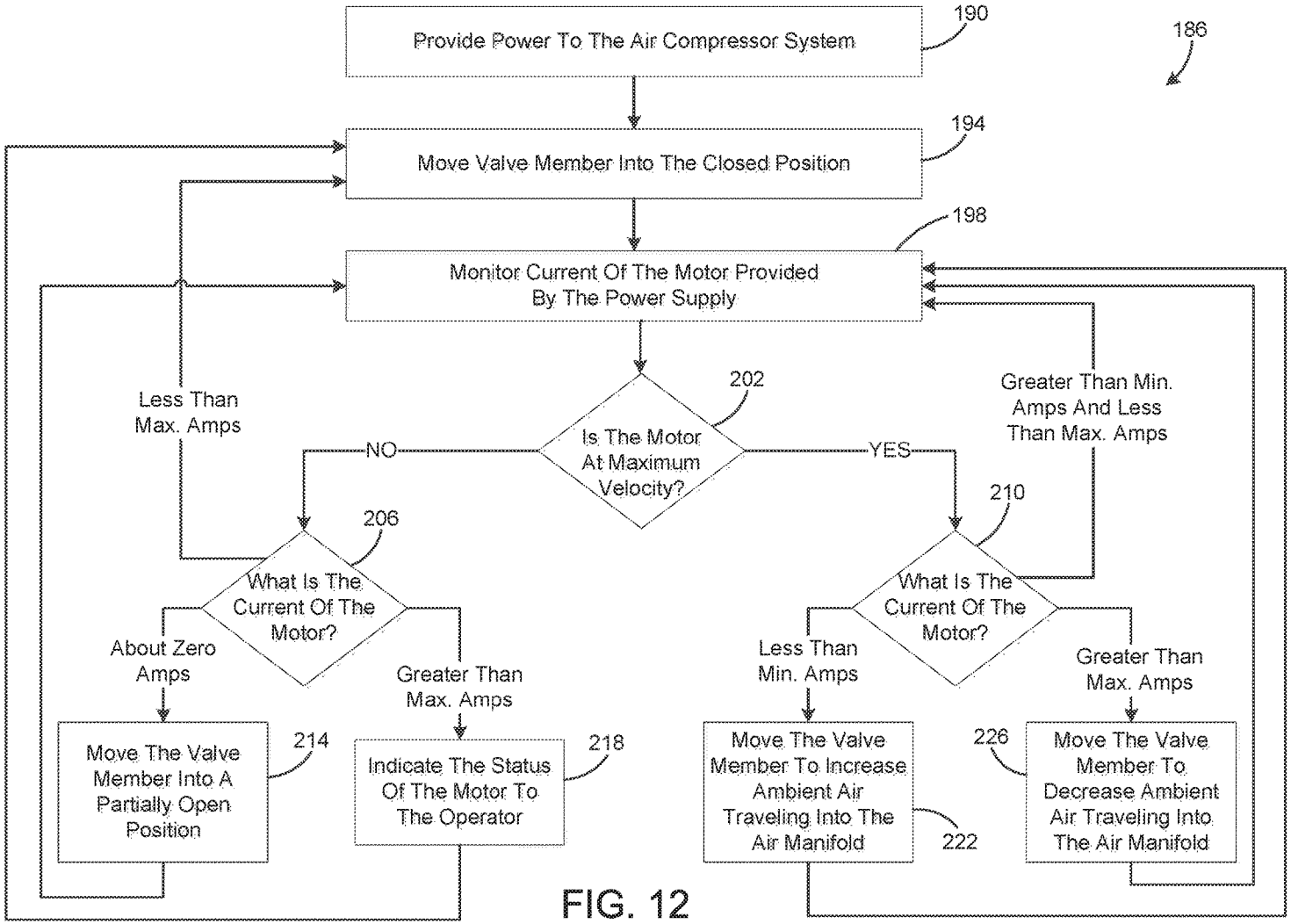
FIG. 12 illustrates a method of operation of the air compressor system according to another embodiment of the invention.

With reference to FIG. 12, another closed-loop method of operation 186 of the air compressor system 10 is illustrated. As described above, upon initial startup of the air compressor system 10 (step 190), the valve member 86 is in the closed position (step 194), and the controller 126 begins to monitor the electrical current traveling through the motor 14 that is provided by the power supply 28 (step 198). The controller 126 also determines if the motor 14 is at maximum operating velocity (step 202), and depending on whether the motor 14 is or is not at the maximum operating velocity, the controller 126 then analyzes (steps 206 and 210) the electrical current traveling through the motor 14. In other embodiments, the controller 126 may first or simultaneously monitor the electrical current traveling through the motor 14 before determining if the motor 14 is at the maximum operating velocity.

If the motor 14 is not rotating at the maximum operating velocity (e.g., rotating below the maximum operating velocity) and the current traveling through the motor 14 is at or about zero amperes (amps), then the controller 126 moves the valve member 86 in a partially open position (step 214). In the illustrated embodiment, the partially open position of the valve member 86 is an intermediate position between the positions of the valve member 86 illustrated in FIGS. 8 and 10. After the controller 126 moves the valve member 86 in the partially open position, the method 186 returns to step 198 to again monitor the electrical current passing through the motor 14.

Step 218 illustrates that the controller 126 indicates an operating status of the motor 14 to the operator when the motor 14 is not rotating at the maximum operating velocity and the electrical current traveling through the motor 14 is greater than the maximum current level of the motor 14. In the illustrated embodiment, the controller 126 visually or audibly alerts the operator that the motor 14 is operating above the maximum current level and below the maximum operating velocity. After the controller 126 alerts the operator, the method 186 returns to step 194 to maintain the valve member 86 in the closed position or to move the valve member 86 into the closed position. In another embodiment, the operator or the controller 126 may turn off the air compressor system 10 after the controller 126 alerts the operator to stop and protect the motor 14 from operating above the maximum current level and below the maximum operating velocity.

In addition, if the motor is not rotating at the maximum operating velocity, and the electrical current passing through the motor 14 is less than the maximum current level of the motor 14, the controller 126 moves the valve member 86 into the closed position (step 194).

However, if the motor 14 is rotating at the maximum operating velocity, but the electrical current traveling through the motor 14 is less than the minimum amps, then the controller 126 moves the valve member 86 to increase the ambient air traveling into the air manifold 38 (step 222). The method 186 then returns to step 198 to again monitor the current passing through the motor 14. In another embodiment, the method 186 may proceed to step 222 when the motor 14 is less than a target ampere level that is between the minimum and maximum amps levels. The target ampere level of the motor 14 is the amperage of maximum performance of the motor 14.

If the motor 14 is rotating at the maximum operating velocity, but the electrical current traveling through the motor 14 is greater than the maximum current level of the motor 14, then the controller 126 moves the valve member 86 to decrease the ambient air traveling into the air manifold 38 (step 226). The method 186 again returns to step 198 to monitor the current passing through the motor 14.

In addition, if the motor 14 is rotating at the maximum operating velocity, and the electrical current traveling through the motor 14 is above the minimum amps level but below the maximum amps level of the motor 14, the controller 126 maintains the position of the valve member 86 and returns to step 198 (e.g., a steady state operating condition). In another embodiment, if the motor 14 is rotating at the maximum operating velocity, and the electrical current traveling through the motor 14 is above the target ampere level but below the maximum amps level of the motor 14, the controller 126 maintains the position of the valve member 86 and returns to step 198.

Although the invention has been described in detail with reference to certain preferred embodiments, variations and modifications exist within the scope and spirit of one or more independent aspects of the invention as described.

The invention claimed is:

1. An air compressor system operably coupled to a power supply, the air compressor system comprising:

an air storage tank;

an air pump including an air manifold having an inlet configured to receive ambient air, the air pump fluidly coupled to the air storage tank;

a motor configured to receive electrical current from the power supply to operate the air pump;

a valve member in fluid communication with the inlet of the air manifold; and a controller including a first predetermined current threshold and a second predetermined current threshold of the motor, the second predetermined current threshold being greater than the first predetermined current threshold;

wherein the controller is configured to move the valve member to increase a rate of ambient air traveling into the manifold when the electrical current received by the motor is below the first predetermined current threshold, and wherein the controller is configured to move the valve member to decrease the rate of ambient air traveling into the manifold when the electrical current received by the motor is above the second predetermined current threshold.

2. The air compressor system of claim 1, wherein the controller defaults the valve member in a position to substantially block fluid communication between the ambient air and the air manifold.

3. The air compressor system of claim 1, further comprising a gear system that couples the controller to the valve member.

4. The air compressor system of claim 3, wherein the valve member is coupled to a first drive gear and the controller is coupled to a second drive gear, and wherein a clutch is positioned between the first and second drive gears.

5. The air compressor system of claim 4, wherein the clutch allows relative rotational movement between the first and second drive gears.

6. The air compressor system of claim 5, wherein the clutch is coupled to a first intermediate gear and a second intermediate gear, and wherein the first drive gear engages the first intermediate gear and the second drive gear engages the second intermediate gear.

7. The air compressor system of claim 1, further comprising a shaft connecting the valve member to the controller.

8. The air compressor system of claim 1, wherein the controller is operable to maintain a position of the valve member when the electrical current is between the first and second predetermined current thresholds.

9. The air compressor system of claim 8, wherein the position of the valve member is less than a fully open position of the valve member.

10. The air compressor system of claim 1, further comprising a frame supporting the air storage tank, the air pump, the motor, the valve member, and the controller, wherein the frame enables transportation of the air compressor system to different locations.

11. The air compressor system of claim 1, further comprising a fitting in fluid communication with the air storage tank, wherein the fitting is configured to be selectively coupled to one of a plurality of tools.

12. An air compressor system operably coupled to a power supply, the air compressor system comprising:

an air storage tank;

an air pump including an air manifold having an inlet configured to receive ambient air, the air pump fluidly coupled to the air storage tank;

a motor operable at an angular velocity and a current level to operate the air pump;

a valve member in fluid communication with the inlet of the air manifold; and a controller operable to move the valve member to either increase or decrease a rate of ambient air traveling into the manifold, the controller monitoring the angular velocity and the current level of the motor to change the rate of ambient air traveling into the manifold.

13. The air compressor system of claim 12, wherein the controller defaults the valve member in a position to substantially block fluid communication between the ambient air and the air manifold.

14. The air compressor system of claim 12, further comprising a gear system that couples the controller to the valve member.

15. The air compressor system of claim 14, wherein the valve member is coupled to a first drive gear and the controller is coupled to a second drive gear, and wherein a clutch is positioned between the first and second drive gears.

16. The air compressor system of claim 15, wherein the clutch allows relative rotational movement between the first and second drive gears.

17. The air compressor system of claim 16, wherein the clutch is coupled to a first intermediate gear and a second intermediate gear, and wherein the first drive gear engages the first intermediate gear and the second drive gear engages the second intermediate gear.

18. The air compressor system of claim 12, further comprising a shaft connecting the valve member to the controller.

19. The air compressor system of claim 12, wherein the controller includes a first predetermined current threshold and a second predetermined current threshold of the motor, wherein the second predetermined current threshold is greater than the first predetermined current threshold, wherein the controller is configured to move the valve member to increase the rate of ambient air traveling into the air manifold when the angular velocity of the motor reaches a predetermined threshold amount and the current level is less than the first predetermined current threshold, and wherein the controller is configured to move the valve member to decrease the rate of ambient air traveling into the air manifold when the angular velocity of the motor reaches the predetermined threshold amount and the current level is greater than the second predetermined current threshold.

* * * * *